United States Patent [19]

McGill et al.

[11] Patent Number: 4,634,369

[45] Date of Patent: Jan. 6, 1987

[54] PURGING PROCESS

[75] Inventors: James C. McGill; John W. Schindeler, Jr., both of Tulsa; Eugene C. McGill, Skiatook; Robert L. Rawlings, Tulsa, all of Okla.

[73] Assignee: McGill Incorporated, Tulsa, Okla.

[21] Appl. No.: 809,586

[22] Filed: Dec. 16, 1985

Related U.S. Application Data

[63] Continuation-in-part of Ser. No. 623,845, Jun. 23, 1984, Pat. No. 4,559,006.

[51] Int. Cl.[4] ..... F23J 15/00; F23D 13/20

[52] U.S. Cl. ..... 431/3; 431/5; 431/29; 431/202

[58] Field of Search ..... 431/3, 5, 18, 29, 202

[56] References Cited

U.S. PATENT DOCUMENTS

| | | | |
|---|---|---|---|
| 3,289,729 | 12/1966 | Reed | 431/202 |
| 3,741,713 | 6/1973 | Reed | 431/202 |
| 3,901,643 | 8/1975 | Reed et al. | 431/202 |
| 3,994,663 | 11/1976 | Reed | 431/5 |
| 4,101,261 | 7/1978 | Straitz | 431/202 |
| 4,139,339 | 2/1979 | Straitz | 431/202 |
| 4,157,239 | 6/1979 | Reed | 431/202 |
| 4,265,611 | 5/1981 | Reed et al. | 431/3 |

*Primary Examiner*—Margaret A. Focarino

*Attorney, Agent, or Firm*—Bill D. McCarthy

[57] ABSTRACT

An improved purging process in which purge gas is flowed through a flare system at a sufficient flow rate to minimize or at least acceptably control the rate of back flow of air migration into the exit port of the system. The flow of purge gas is periodically terminated (or reduced) for a predetermined interval of time during which air begins to migrate into the flare system. During this purge gas cessation interval, the flow rate of the flare gas is sensed, and depending upon predetermined flow rate ranges for the flare gas, the purge gas cessation is continued during the cessation interval or a partial purge gas flow is commenced to assure that the total gas flow rate in the system is maintained above a predetermined flow rate. In any event, once the cessation interval of time has lapsed, the full purge gas flow is re-established to assure that air migration is cleared from the system.

18 Claims, 5 Drawing Figures

PURGING PROCESS

CROSS REFERENCE TO RELATED APPLICATION

This application is a continuation-in-part to U.S. application Ser. No. 623,845, entitled PURGING PROCESS, filed June 23, 1984 and now U.S. Pat. No. 4,559,006.

BACKGROUND OF THE INVENTION

1. Field of Invention

The present invention relates generally to the field of flare gas combustion, and more particularly, but not by way of limitation, to an improved process of purging flare systems and the like.

2. Discussion of Background

Flares are devices used throughout the petroleum and chemical industries to burn combustible gases which exit the process and would otherwise flow to the atmosphere as unburned hydrocarbons. Sometimes very large volumes of these gases are released through safety devices to the atmosphere; failure to burn these gases in a flare could result in a serious safety hazard, such as a vapor cloud explosion.

A typical prior art flare system may have a series of conduits which connect gas sources to a vertical stack, but other types of flares also have difficulties that are described herein for vertical stacks. A typical stack has several pilot fires burning continuously at the exit port, and combustibles are ignited as they are exhausted to the atmosphere. The burning of large volumes of discharging gas can generate significant radiant heat and the flare stacks are therefore often made quite tall in order to minimize radiant heat damage at ground level.

Flares, including the flare stacks just described, are continuously purged with a gaseous fluid to prevent air from entering the exit port and migrating into the stack; such air migration can present dangerous mixtures of air and unburned hydrocarbons. This purging usually consists of flowing a purge gas through the flare system at a rate sufficient to prevent backflow of air down the stack. The purge gas, commonly a fuel gas or nitrogen, serves to keep air out of the stack, thus preventing formation of certain mixtures of air and gas which, when ignited, can result in explosions within the flare stack.

Until recent times the amount of purge gas used was of little concern as fuel gas and nitrogen were very inexpensive. However, basic costs of energy have risen dramatically over the past several years and the cost of purge gas has risen as well. As a consequence, several prior art devices have been used which substantially reduce purge gas flow rates required to effectively prevent air migration in flare systems. These prior art devices serve to retard the flow of air down the stack.

SUMMARY OF INVENTION

The present invention provides an improved purging process in which purge gas is flowed through a flare system at a suffiient flow rate to substantially control the rate of back flow air migration into the exit pot at the exit of the system. The flow of purge gas is periodically interrupted; that is, the flow of purge gas is ceased for a predetermined interval of time during which air begins to migrate into the flare system. Before this admittance of air can result in a hazardous condition within the system, the flow of purge gas is re-established to sweep the air back out of the system. During the interval of time of purge gas flow interruption, the flow rate of flare gas is determined and purge gas is again started during the interruption if certain flow rate conditions occur.

This carefully controlled interruption of purge gas flow results in a significant reduction in the amount of purge gas required and thus provides advantageous cost savings. Also, longer flare system life results since the flame at the exit of the system is extinguished during such periods of purge gas interruption; this substantially extends flare tip life because the continuous existence of flame at the exit port inevitably results in deleterious effects on the system.

An object of the present invention is to provide an improved purge gas process requiring a minimum amount of purge gas to achieve safe operation of a flare stack system.

Another object of the present invention, while achieving the above stated object, is to minimize the cost of safely purging a flare stack system.

Yet another object of the present invention, while achieving the above stated objects, is to provide a purging process which extends the operating life of a flare gas system tip.

Other objects, advantages and features of the present invention will become clear from the following detailed description when read in conjunction with the accompanying drawings and with the appended claims.

DESCRIPTION

Figure 1:
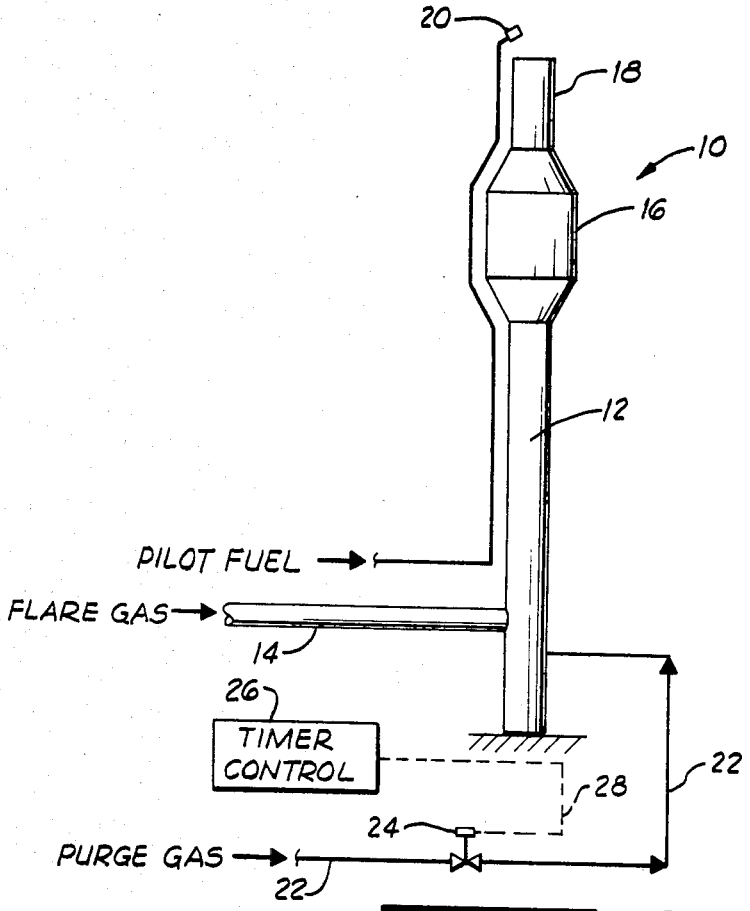
FIG. 1 is a semi-detailed schematic representation of one embodiment of a flare gas system to perform the present inventive process.

With reference to FIG. 1, waste gases are supplied to a flare system 10 having a flare stack 12 via a conduit 14. The waste gas flows upward through a purge reduction seal 16 to a tip 18 where it exits the flare system 10. The purge reduction seal 16 is not required to practice the invention but is preferred due to its ability to reduce the purge gas flow. The purge reduction seal and flare tip are discussed further hereinbelow.

The flare system 10 further comprises a continuous burning pilot 20 disposed near the flare tip 18. The purpose of the pilot 20 is to ignite any gas exiting the flare tip 18.

Purge gas flows through a conduit 22 and a motor valve 24 to the base of the flare stack 12. The flow of purge gas continuously sweeps air from the stack when no flow of flare gas via conduit 14 occurs. As discussed herein, the interruption of purge gas flow results in a slow migration of air into the stack via the exit tip 18. Research into this phenomena now allows prediction of the rate at which air migration into the system will occur and thus the length of time that purge flow may be interrupted without excessive amounts of air entering the system. A conventional timer control 26 closes the valve 24 for a predetermined time interval via an electric signal through a conduit 28 connected thereto and signals to reopen valve 24 at the end of the selected time interval.

Figure 2:
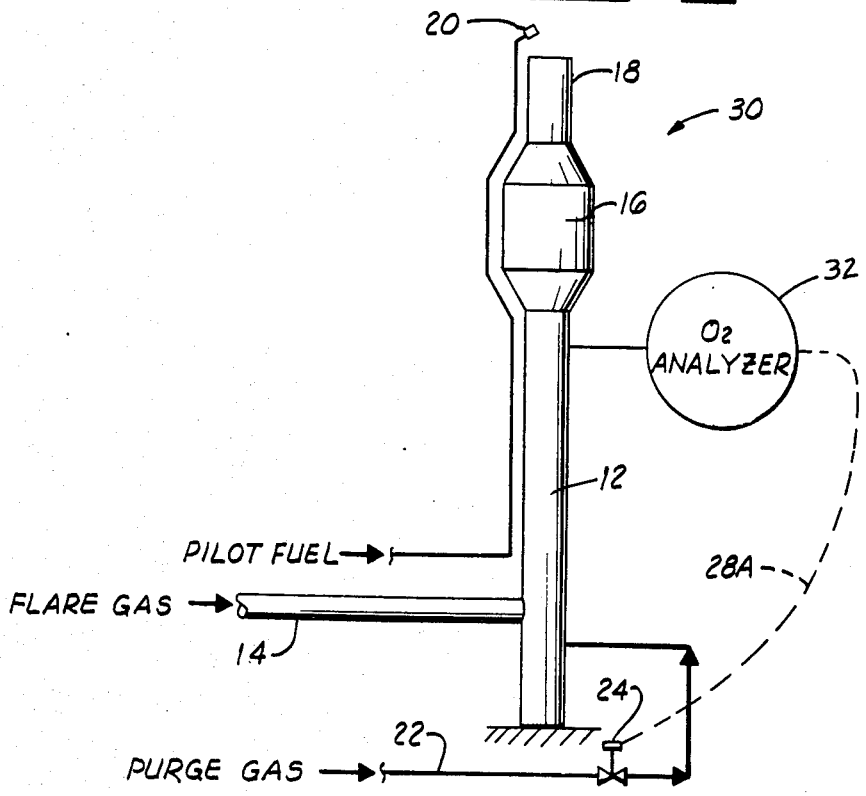
FIG. 2 is a semi-detailed schematic representation of another flare gas system to perform the present inventive process.

FIG. 2 is another flare system 30 for the practice of the present invention. Except as now indicated, the flare system 30 is identical to the previously described flare system 10, and like numerals appear in FIG. 2 to identify the same components. As shown in FIG. 2, a conventional oxygen analyzer 32 is used to measure the oxygen content in the flare stack 12 and actuate the valve 24 based on the measured oxygen content. That is, the oxygen analyzer 32 is set to signal the opening and closing of the valve 24 via the conduit 28A connected thereto in order to effect the flow of purge gas only when the oxygen content exceeds a safe limit.

Figure 3:
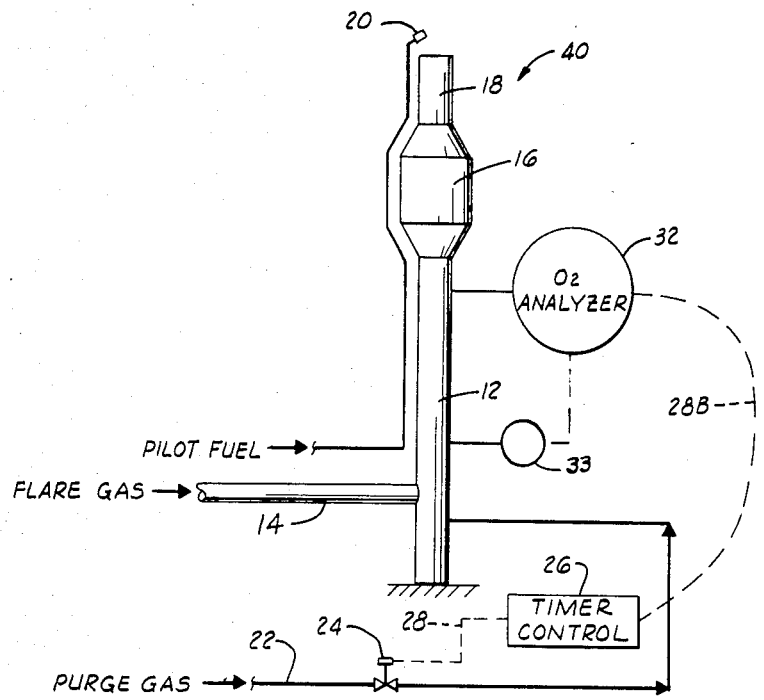
FIG. 3 is a semi-detailed schematic representation of yet another flare gas system to perform the present inventive process.

FIG. 3 shows yet another flare system 40 for the practice of the present invention. As for FIG. 2 above, like numerals are used in FIG. 3 to identify the same components described hereinabove for the flare system 10 and for the flare system 20. In FIG. 3, purge gas flow is periodically interrupted by the oxygen analyzer 32 causing valve 24 to selectively open and close via a signal through conduit 28B connected to the timer control 26 and thus to the valve 24. Thus the timer control 26 is interposed in the control system such that the valve 24 is opened and closed by either the oxygen analyzer 32 or the timer control 26. This adds a control redundancy, and consequently, creates a safer system.

A further refinement of the present invention is depicted in FIG. 3 wherein one or more process condition sensors are represented by the sensor 33 disposed to sense a change of a predetermined process condition within the stack 12. For example, where the sensor 33 is a temperature sensor, a change in stack temperature is obtained for use in conjunction with the oxygen analyzer 32 and the timer control 26 to control the purge gas interruption. If preferred, the sensor 33 can as well be located elsewhere such as in the conduit 14, which can prove beneficial in the case where the flare gas passing through the stack 12 is affected by the release of a condensable vapor. Where condensation is occurring in the stack, there is a consequent pulling of air into the flare by attendant pressure reduction.

The process condition sensor 33 can also take the form of being an optical, pressure or vacuum sensor. Also, as discussed further hereinbelow, the sensor 33 can be a flow measurement device which is capable of sensing the flow rate of gas in the stack 12; in such a case, the flow sensor 33 can be a conventional device which is preferably capable of determining when the gas flow rate in the stack is within predetermined flow rate ranges, for the purpose described below.

Figure 4:
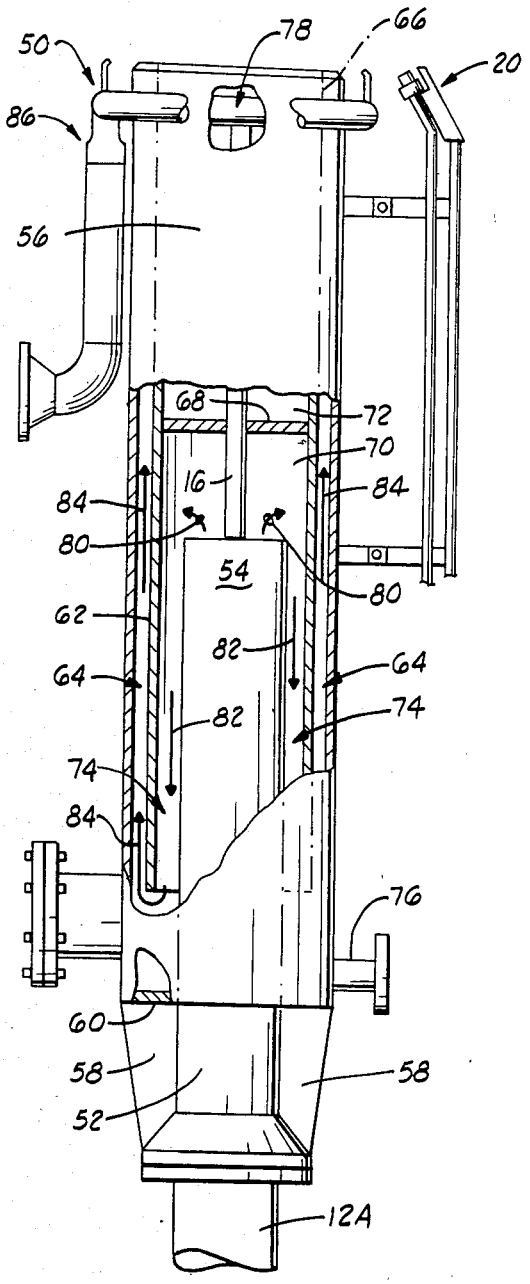
FIG. 4 is a flare tip assembly that incorporates a reverse flow seal chamber which further reduces the amount of flare gas used in the present inventive process.

A pure reduction seal of the type discussed briefly above and enumerated 16 will now be described with reference to FIG. 4. Shown therein is a single stage flare tip assembly 50 which attaches to the upper end of a conventional, single conduit flare stack 12A and which is constructed in accordance with my U.S. patent application Ser. No. 485,623, Smoke Suppressant Apparatus for Flare Gas Combustion, filed Apr. 18, 1983 and incorporated by reference herein insofar as necessary for purposes of the present teaching. Flare gas discharge from the flare tip assembly 50 will be configured as a relatively thin layer of cylindrically shaped flare gas. The flare tip assembly 50 comprises a bolt-on flare conduit section 52 which extends upwardly from the flare stack 12A, the flare conduit 52 having an open upper end 54. A cylindrically or tubularly shaped flare housing 56 is connected to the flare conduit 52 via a pair of gusset supports 58 and by an annular bottom plate 60 welded to the lower end of the flare housing 56 and to the outer wall of the flare conduit 52. Disposed coaxially within the flare housing 56 is a liner cylinder 62 which is supported via a number of vertically extending divider members (not shown) that weldingly interconnect the liner cylinder 62 and the flare housing 56. Formed between the coaxially disposed liner cylinder 62 and the flare housing 56 is an annular orifice channel 64 which has an exit port at the upper end 66 of the liner cylinder 62, the annular orifice channel 64 being sealed at its lower end by the bottom plate 60.

The liner cylinder 62 has a seal plate 68 welded to the internal wall of the liner cylinder 62 and dividing same into a lower portion 70 and an upper portion 72. The flare conduit 52 extends upwardly into the lower portion 70 of the liner cylinder 62, having its upper end 54 disposed below the seal plate 68. Formed between the inner wall of the liner cylinder 62 and the outer wall of the flare conduit 52 is an annularly shaped reverse flow channel 74, the reverse flow channel 74 having fluid communication with the annular orifice channel 64 as shown. If desired, a fluid injector pipe 76 can extend through the walls of the flare housing 56 and the liner cylinder 62 and connected to and in fluid communication with an externally disposed fluid injector 78.

In the flare tip assembly 50, flare gas passes upwardly via the flare conduit 52 and flows from the upper ends 54, the upward flow thereof being blocked by the plate 68 which serves to seal the upper portion 72 of the liner cylinder 62. The flare gas is caused to reverse it upward direction to flow downwardly through the annularly shaped reverse flow channel 74 as indicated by the arrows 80 and 82. The lower end of the liner cylinder 62 is disposed somewhat above the bottom plate 60, and the gas discharging from the reverse flow channel 74 is again caused to reverse its direction and to flow upwardly into the annular orifice channel 64, as indicated by the arrows 84; the flare gas discharges at the exit port of the annular flow channel 64 provided at the top of the flare tip assembly 50. The flare gas can be discharged from the annular orifice 64 into the atmosphere in the form of a perimeter zone discharge, or it can be passed to the tip 18 as shown in the previous figures.

The flare tip assembly 50 may be equipped with an externally disposed fluid injector assembly 86 and with the conventional pilot 20. Also, the upper portion of the internal wall of the liner cylinder may be lined with a refractory (not shown) if required to protect the structure from the burning flare gas.

The flare tip assembly 50 provides a reverse flow seal chamber between the flare conduit 52 and the annular orifice channel 64. During purge operations, this reverse flow seal chamber serves to entrap a portion of the purge gas generally within the space formed in the reverse flow channel 74 below the seal place 68 and the lower portion of the annular orifice channel 64, and this occurs whether the purge gas is heavier or lighter than atmospheric air. The result of this purge gas entrapment is to minimize the amount of purge gas required to retard the backflow of atmospheric air into the flare stack.

EXAMPLES

A series of tests were performed to determine the rise in oxygen content versus time for two types of flare tips mounted on a reverse flow seal chamber. A basic pipe flare tip consisting of a straight section of pipe was used in one series of tests. This basic pipe flare tip is of a design well known to those skilled in the art and represents the most simple type of flare tip. A flare system of the type depicted in FIG. 4 hereinabove was used in a second series of tests; in contrast to the simple basic flare tip, the flare system 40 represents an advanced technology tip of the latest designs commercially available. Both tips were mounted on conventional reverse flow seal chambers and mounted on stacks. An oxygen analyzer was used to monitor the oxygen content below the reverse flow seal chamber. Natural gas was introduced at the base of the flare stack.

Figure 5:
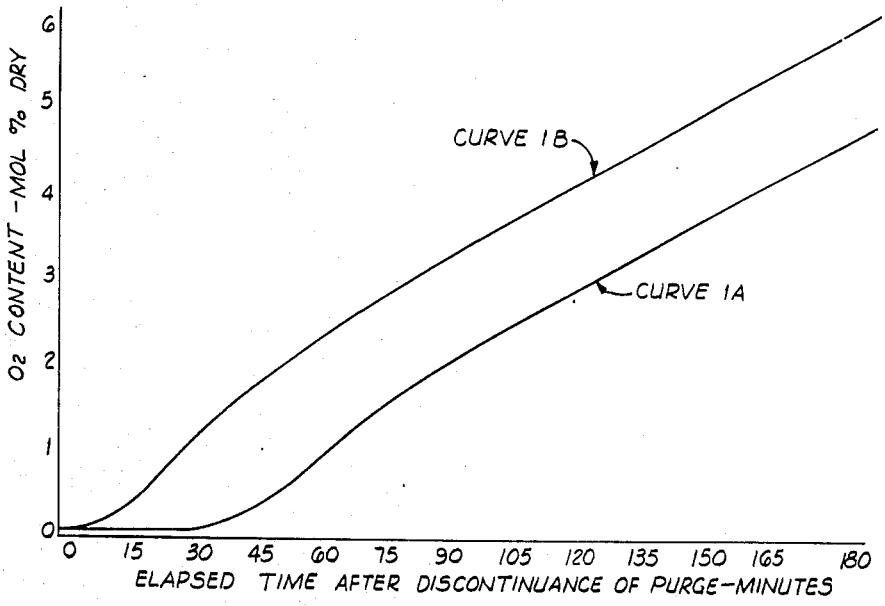
FIG. 5 is a graphical depiction of tests performed on two types of flare tip systems in the performance of the present inventive process.

Purge gas was used initially to clear all oxygen from the system. The purge gas flow was then stopped and the oxygen content measured versus time. After collection of oxygen measurements, the system was purged again and the decay curve data of FIG. 5 generated. The data varied with type of tip and weather conditions but all fit within the band shown on FIG. 5 between curves 1A and 1B.

One series of tests were performed to specifically determine the time required to purge the air from the system versus the flow rate of the purge gas. In these tests, the purging was continued until the oxygen content was less than 1% and then interrupted for one hour. The oxygen content was recorded at the end of one hour and then the purge flow was re-established and the time required to reach an oxygen content of less than 1% measured. Typical results for 18 inch outer diameter vertical flare stack with reverse flow seal as shown in FIG. 4 are provided in the following table.

| Oxygen @ start | Oxygen after 1 Hour | Minutes Purge Time | fps Purge Velocity |
|---|---|---|---|
| 0.95% | 1.45% | 10 | 0.004 |
| 0.85% | 1.40% | 13 | 0.003 |
| 0.90% | 1.50% | 17 | 0.002 |

The oxygen concentrations shown in the above table of data are recognized under good engineering practices as being within acceptably safe operating conditions for vertical flare stacks. It is believed that significant deviations from these conditions can be tolerated without presenting a safety hazard.

While this data is for a vertical stack and will enable one skilled in the art (using generally accepted extrapolation techniques) to calculate the design requirements for any size vertical flare, it will be understood that one skilled in the art could use similar techniques to predict design criteria for other types of flares, such as, but not limited to, ground flares, pit flares and inclined boom flares now commonly found in the art.

It has been determined that purge gas control as described hereinabove saves considerable purge gas. However, if a very small volume of gas is flowing to the flare 12 from its source, the period during which purge gas is terminated, or shut off, may result in an occasional burn back problem. The present invention provides a method of preventing the possibility of burn back during periods of no purge gas flow.

Studies of minimum purge gas flow in basic flare tips has indicated that there are three zones, or ranges, of low flow conditions which can occur in a flare gas purge system of the type hereinabove described. These ranges are as follows:

| Low Range | Transition Range | High Flow |
|---|---|---|
| Observation: No Fire. | Observation: Fire floats, whooshes or hums. | Observation: Fire burns outside the stack tip. |
| → Riser Velocity Increasing | | |

This tabular depiction of observations presents the results of research studies which provided the following results. In the low range of riser velocity (or flow rate) as sensed by the flow or velocity sensor 33 (FIG. 3), no significant fire occurred within the tip, which was determinable from skin temperature measurements. It was assumed that any flame, or burn back, was quickly snuffed due to lack of fuel, air or both.

The transition range demonstrated ignition of the flare gas at the tip followed by rapid retreat of the flame down the stack and snuffing of the flame due to lack of oxygen. The high flow range demonstrated fire burning clear of the tip; this is the desired flame characteristic in a purged flare of the type described hereinabove.

The present invention recognizes the desirability for further process refinements for protection of flare tips from burn-back due to flare gas discharge such as that which occurs from process leakage or the like during zero purge flow rates as called for in the above described purge gas cut off process. Specifically it has been determined that the flow sensor 33 affords the means, in conjunction with the other components, such as the timer control 26 and motor valve 24 of FIG. 3, for establishing override controls during zero flow of purge gas flow through the flare system 40, as follows, during the interval of time that purge gas is ceased:

(1) If the sensor 30 determines that the gas flow rate of flare gas in the stack 12 is in the low range, the purge gas in conduit 22 would remain shut off via the motor valve 24 as described above under the discussion of the flare system 40.

(2) If the flow rate of flare gas in the stack 12 during the cessation interval is measured in the transition range during purge gas shut off in conduit 22 (that is, when the process of flare system 40 would call for this no purge condition), the present invention would provide an override control in the timer control 26 so that the motor valve 24, instead of being completely closed, would be opened partially to admit a sufficient amount of purge gas via the conduit 22 to increase the flow rate as sensed by the sensor 33 to be within the high flow range.

(3) Finally, if the sensor 33 determines that the flow rate of the flare gas in the stack 12 during the cessation interval is in the high flow range when the purge gas is shut off via the motor valve 24, no override of the timer control 26 would occur.

In effect, the present invention presents a refinement to the above described process of flare system 40 in recognition that a complete shut off of the purge gas at intervals, while many times advisable for a particular application, can at times be accompanied by burn back conditions which can be prevented by implementing an override control over such purge shut off, that is, by requiring that flow rate conditions within the stack be present before complete purge shut off can be effected by the purge gas motor valve and its control devices. The following example of the flow rate/purge gas studies will demonstrate further this invention with commentary on the attending observations.

EXAMPLE

In the determination of the ranges of flow rates for a particular flare system, empiral observations were employed together with certain process parameter measurements. Tests were conducted in three sizes of open pipe flares (6 inch, 18 inch and 36 inch diameters equipped with one or more pilot flames) using natural gas (largely methane) as the flared and destroyed gas. The volume of flare gas flowing to the pipe flare was measured by appropriate means, and from this, the velocity of the flare gas in the pipe flare was readily available by usual calculations. By varying the velocity of the flare gas in the pipe flare while observing the fire phenomenon, the velocity ranges described in the above table could be determined for the flare. Specifically, flare gas flow was varied to establish the velocity ranges where the following occurred during the tests:

1. The fire burned clear of the tip;
2. The fire retreated into the tip but did not go out;
3. The fire retreated into the tip so far that it went out and then reignited several seconds later; and
4. The fire did not burn inside the tip.

Data obtainied from the tests, that is, velocity ranges and observed fire phenomenon was correlated, and from these, it was clear that extrapolations can be made to predict flare gas flow rate and expected fire phenomena characteristics for any size of flare. Also, purge gas termination, or reduction to partial flow, during the cessation interval was observed, as indicated, as to its contribution to flame stability at the flare outlet, with the result being that partial purge gas flow determined to increase the total gas velocity (flare and purge gas combined) into the high velocity range did provide the desired flame stability. It was therefore concluded that flame stability can be maintained over a wide range of flare gas velocities while implementing the purge gas cyclic interruptions of the present invention.

It should be clear that the above described purging process for controlling the rate of back flow migration by ceasing the flow of purge gas to permit air migration to occur for selected time intervals, subject to the process condition that gas flow rates in the flare stack are maintained within a predetermined flow range, achieves the stated objects of minimizing purge gas consumption while maintaining safe operating conditions within as flare stack system. In fact, the present invention is well adapted to carry out the objects and to attain the ends and advantages mentioned as well as those inherent therein. While presently preferred embodiments have been described for purposes of this disclosures, numerous changes may be made which will readily suggest themselves to those skilled in the art and which are embodied within the spirit of the invention disclosed and as defined in the appended claims.

We claim:

1. An improved purging process for controlling backflow migration of air into a flare system through which a flare gas is caused to be destroyed, the process comprising:

flowing purge gas through the flare system in a sufficient amount to substantially prevent air migration into the exit port through which the purge gas is exhausted to the atmosphere;

sensing the flow rate of the flare gas being passed through the flare system;

reducing the flow of purge gas to permit substantial air migration to occur, said reduction of purge gas being for a selected interval of time and the amount of reduction being a predetermined amount in response to the sensed flare gas flow rate; and re-establishing the full flow of purge gas at the end of the interval such that only a predetermined amount of migration air has occurred to prevent harmful conditions from occurring as a result of the air migration.

2. The process of claim 1 wherein the step of reducing the flow of purge gas comprises ceasing the purge gas flow when the sensed flare gas flow rate is greater than a first predetermined flare gas flow rate.

3. The process of claim 2 wherein the step of reducing the flow of purge gas comprises decreasing the purge gas flow when the sensed flare gas flow is less than the first predetermined flow rate and greater than a second predetermined flow rate, the rate of purge gas flow being determined by said decreasing of same such that the flow rate of flare gas and purge gas is at least equal to the first predetermined flow rate.

4. The process of claim 3 wherein the step of reducing the flow of purge gas comprises complete cessation of purge gas flow when the sensed purge gas flow rate is equal to or less than the second predetermined flare gas flow rate.

5. The process of claim 4 wherein the control of the purge gas is effected by a timing device which reduces the flow of purge gas at the predetermined intervals.

6. The process of claim 5 wherein the control of purge gas is effected by an oxygen analyzer means for measuring the oxygen content in the flare system and for re-establishing the flow of purge gas when the oxygen content in the flare system exceeds predetermined values of oxygen content of the gas mixture in the flare system.

7. The process of claim 6 wherein the control of purge gas is effected by a timing device which reduces the flow of purge gas at predetermined intervals.

8. The process of claim 7 wherein the control of purge gas is effected by a sensor device which senses a predetermined condition in the flare stack and which re-establishes full flow of purge gas when the predetermined condition is sensed.

9. The process of claim 8 wherein the sensor device is a temperature sensor and the predetermined condition is a predetermined temperature.

10. The process of claim 8 wherein the sensor device is a vacuum sensor and the predetermined condition is a predetermined pressure.

11. An improved purging process for controlling the rate of back flow migration of air into a flare system through which a flare gas is caused to flow, the process comprising:

flowing purge gas through the flare system in a sufficient amount to substantially prevent air migration into the exit port through which the purge gas is exhausted to the atmosphere;

ceasing the flow of purge gas to permit substantial air migration to occur, said ceasing of purge gas being for a selected cessation interval of time;

sensing the flow rate of the flare gas during the cessation interval of time during which the purge gas has been ceased;

starting a partial flow of purge gas during the selected interval of time when the sensed flare gas flow rate is less than a first flare gas flow rate; and re-establishing the full flow of purge gas at the end of the cessation interval of time such that only a predetermined amount of migration air has occurred to prevent harmful conditions from occurring as a result of the air migration.

12. An improved purging process for controlling the rate of back flow migration of air into a flare system through which a flare gas is caused to flow, the process comprising:

flowing purge gas through the flare system in a sufficient amount to substantially prevent air migration into the exit port through which the purge gas is exhausted to the atmosphere;

ceasing the flow of purge gas to permit substantial air migration to occur, said ceasing of purge gas being for a selected cessation interval of time;

sensing the flow rate of the flare gas during the cessation interval of time during which the purge gas has been ceased;

starting a partial flow of purge gas during the selected interval of time when the sensed flare gas flow rate is in a transition range defined as being between a first flare gas flow rate and a second flare gas flow rate, the cessation of purge gas continuing if the sensed purge gas flow rate is either side of said transition range, the partial flow of purge gas being sufficient to effect a total flow of purge gas and flare gas at a rate above the transition range; and re-establishing the full flow of purge gas at the end of the cessation interval of time such that only a predetermined amount of migration air has occurred to prevent harmful conditions from occurring as a result of the air migration.

13. The process of claim 12 wherein the cessation of the purge gas is effected by a timing device which ceases the flow of purge gas at the predetermined intervals.

14. The process of claim 12 wherein the cessation of purge gas is effected by an oxygen analyzer means for measuring the oxygen content in the flare system and for re-establishing the flow of purge gas when the oxygen content in the flare system exceeds predetermined values of oxygen content of the gas mixture in the flare system.

15. The process of claim 14 wherein the cessation of purge gas is effected by a timing device which ceases the flow of purge gas at predetermined intervals of time.

16. The process of claim 12 wherein the cessation of purge gas is effected by a sensor device which senses a predetermined condition in the flare stack and which reestablishes full flow of purge gas when the predetermined condition is sensed.

17. The process of claim 16 wherein the sensor device is a temperature sensor and the predetermined condition is a predetermined temperature.

18. The process of claim 16 wherein the sensor device is a vacuum sensor and the predetermined condition is a predetermined pressure.

* * * * *